US008251764B2

(12) United States Patent
Hsu

(10) Patent No.: US 8,251,764 B2
(45) Date of Patent: Aug. 28, 2012

(54) SWIM FIN

(76) Inventor: Chien Cheng Hsu, Dongguan (CN)

( * ) Notice: Subject to any disclaimer, the term of this patent is extended or adjusted under 35 U.S.C. 154(b) by 0 days.

(21) Appl. No.: 12/428,016

(22) Filed: Apr. 22, 2009

(65) Prior Publication Data

US 2010/0273371 A1 Oct. 28, 2010

(51) Int. Cl.
*A63B 31/08* (2006.01)

(52) U.S. Cl. ..... 441/64

(58) Field of Classification Search ..... 441/64; 114/205, 213, 215
See application file for complete search history.

(56) References Cited

U.S. PATENT DOCUMENTS

| | | | | |
|---|---|---|---|---|
| 7,281,963 | B1 * | 10/2007 | Feng et al. | 441/64 |
| 7,699,014 | B1 * | 4/2010 | Harrison | 114/230.1 |
| 2003/0027469 | A1 * | 2/2003 | Testa | 441/64 |

* cited by examiner

*Primary Examiner* — Stephen Avila

(57) ABSTRACT

A swim fin includes a foot cover, a fin blade, and a pair of reinforcement ribs extending from two sides of the foot cover. The fin blade is disposed between the pair of the reinforcement ribs and fixedly connected to the pair of the reinforcement ribs. Each reinforcement rib includes a front rib portion, a middle rib portion, and a rear rib portion. The rear rib portion has a bottom fixedly connected to the foot cover. The middle rib portion has at least a cavity extending axially and a spring in the cavity to improve the resilience of the reinforcement rib. The spring has two ends connected to the front rib portion and the rear rib portion, respectively. The one spring or the plurality of springs in the reinforcement rib of the present invention is to replace a conventional solid reinforcement rib, with the property of the spring.

2 Claims, 3 Drawing Sheets

SWIM FIN

BACKGROUND OF THE INVENTION

1. Field of the Invention

The present invention relates to a swim fin, and more particularly to one having a better resilience.

2. Description of the Prior Art

Swim fins have been in use for many years by recreational swimmers and divers. A conventional swim fin comprises a foot cover, a fin blade and a pair of reinforcement ribs extending from two sides of the foot cover. The fin blade is located between the pair of the reinforcement ribs, and fixedly connected to the pair of the reinforcement ribs and a front portion of the foot cover. The fin blade is adapted to provide propulsion of the user in water. Swim fins are generally put on once the swimmer is in the water, and they are popular as they increase the water-pushing power of the swimmer's legs, thereby increasing the swimmer's speed through the water and helping the swimmer stay afloat more easily. The pair of reinforcement ribs has a specific toughness for providing deformation resilience to the fin blade. When wearing the swim fin the user is able to complete the motions of propulsion, diving and floating. The degree of the motion depends on the frequency and range of the swim fin's swing. However, the reinforcement ribs of the conventional swim fin are made in a solid plastic stick. The deformation resilience of the solid plastic stick is limited. The resilience of the swim fin is decided by the solid plastic stick, which influences the speed of the swimmer.

SUMMARY OF THE INVENTION

The primary objective of the present invention is to improve the shortcomings existing in the prior art and to provide a swim fin having a better resilience, which is an innovative design to combine ergonomics and professional knowledge and materials of diving. With a pair of reinforcement ribs at two sides of the swim fin, the present invention overcomes the aforesaid shortcomings and provides a better resilience to achieve the advantages of effort-saving and good flexibility.

According to the present invention, there is provided a swim fin comprising comprises a foot cover, a fin blade, and a pair of reinforcement ribs extending from two sides of the foot cover, the fin blade being disposed between the pair of the reinforcement ribs and fixedly connected to the pair of the reinforcement ribs, each reinforcement rib comprising a front rib portion, a middle rib portion, and a rear rib portion, the rear rib portion having a bottom fixedly connected to the foot cover, the middle rib portion having at least a cavity extending axially and a spring in the cavity to improve the resilience of the reinforcement rib, the spring having two ends connected to the front rib portion and the rear rib portion, respectively.

Preferably, a limit rope is provided in the spring, the limit rope having two ends fixedly connected to the two ends of the spring.

Preferably, the middle rib portion has at least a cavity extending axially and a plurality of through holes interconnecting with the cavity.

Preferably, the two ends of the spring are provided with two rings, the two rings being connected to the front rib portion and the rear rib portion, respectively.

Preferably, a space is formed between the middle rib portion and the fin blade.

The one spring or the plurality of springs in the reinforcement rib of the present invention is to replace a conventional solid reinforcement rib, with the property of the spring to improve the resilience of the reinforcement rib. The swim fin of the present invention provides a better resilience for a user to consume less energy and to advance greatly, achieving the advantages of effort-saving and good flexibility.

DETAILED DESCRIPTION OF THE PREFERRED EMBODIMENT

Embodiments of the present invention will now be described, by way of example only, with reference to the accompanying drawings.

Figure 1:
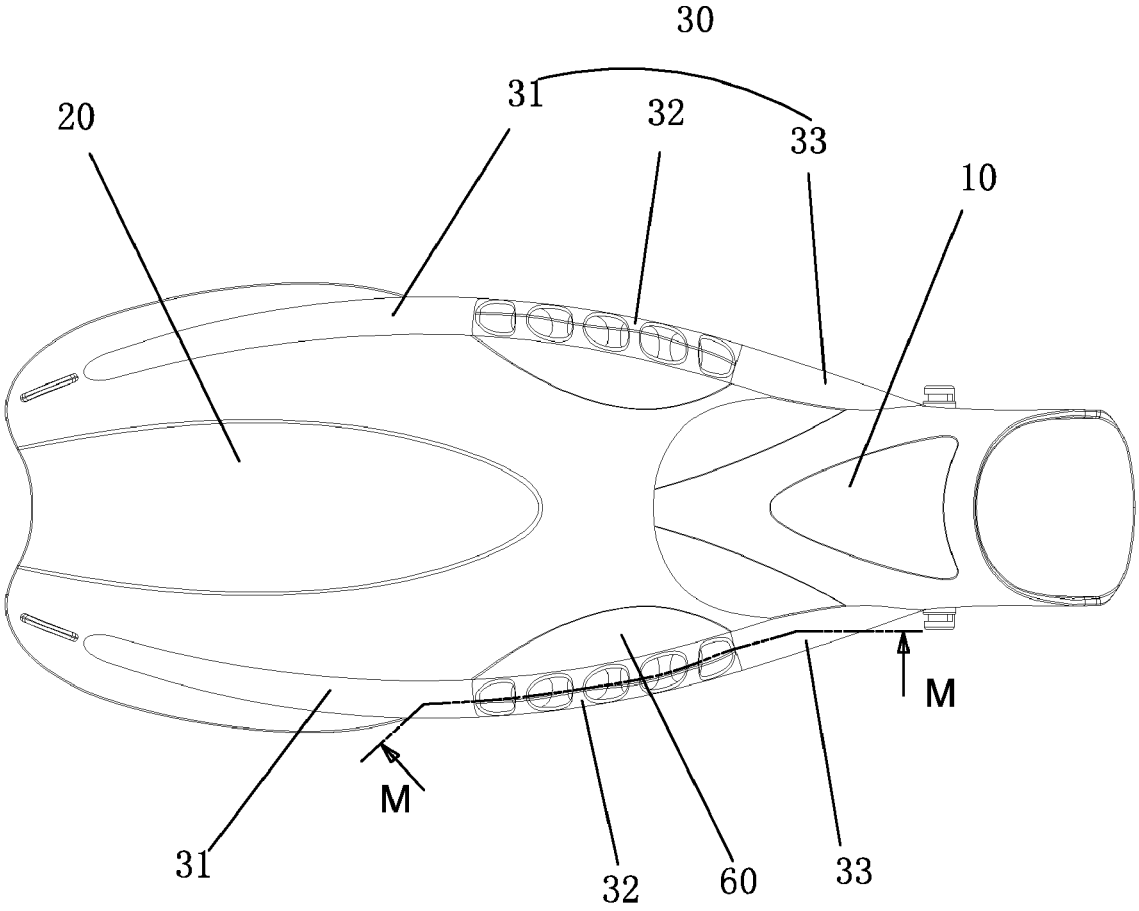
FIG. 1 is a top view according to a preferred embodiment of the present invention.
Figure 2:
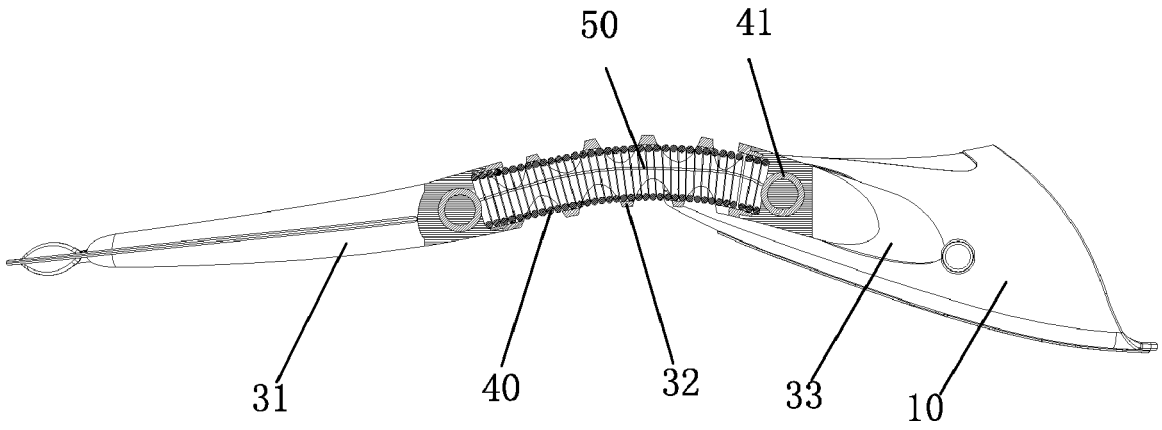
FIG. 2 is a cross-sectional view taken on line M-M of FIG. 1.
Figure 3:
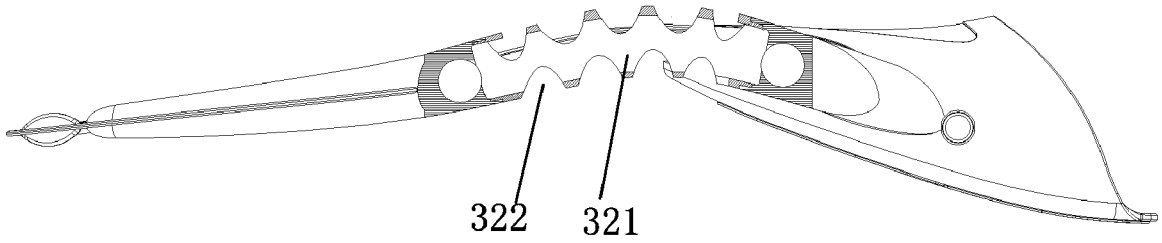
FIG. 3 is a cross-sectional view similar to FIG. 2 without a spring.
Figure 4:
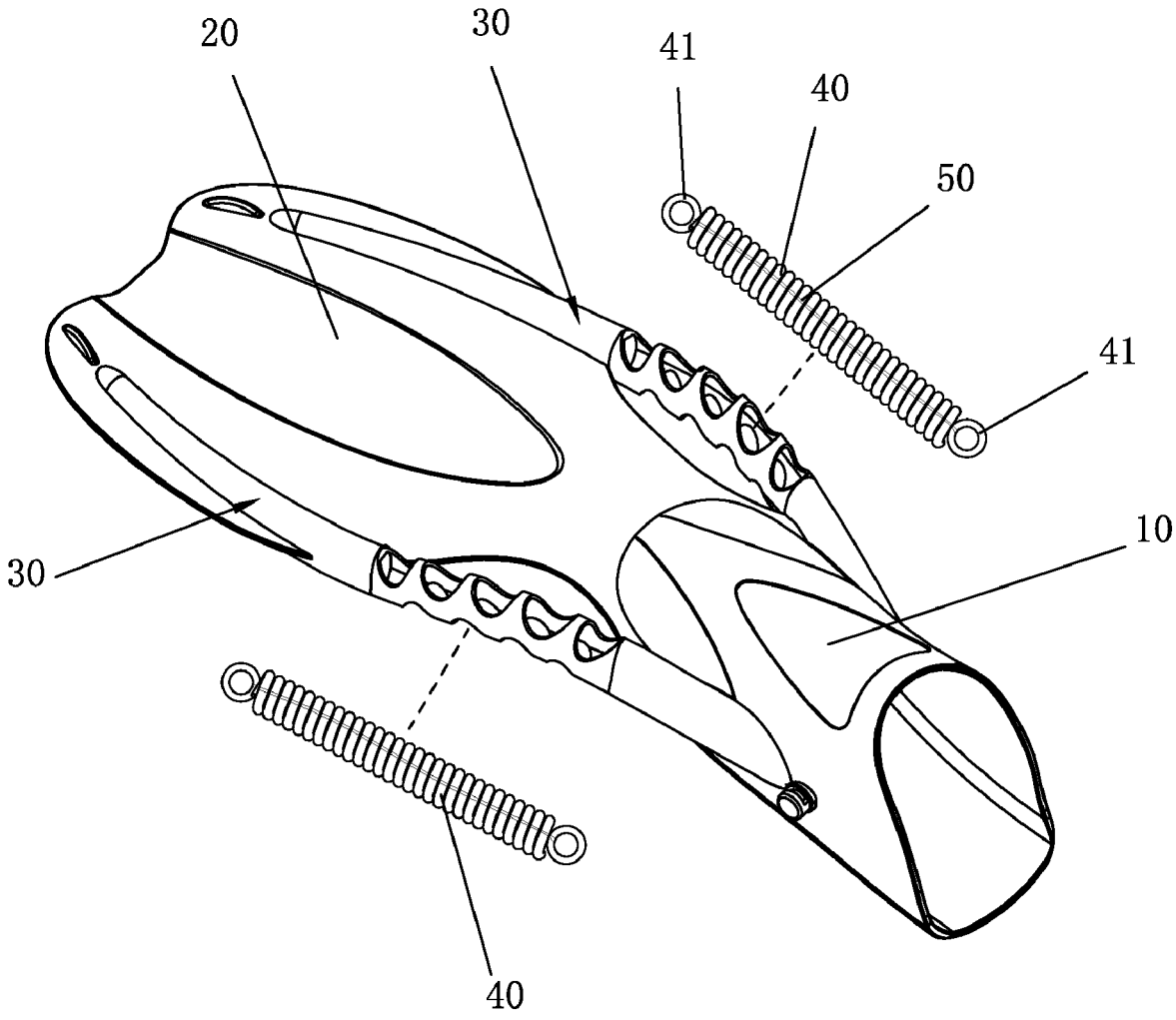
FIG. 4 is an exploded view according to the preferred embodiment of the present invention.

As shown in FIGS. 1 through 4, a swim fin according to a preferred embodiment of the present invention comprises a foot cover 10, a fin blade 20, and a pair of reinforcement ribs 30 extending from two sides of the foot cover 10. The fin blade 20 is disposed between the pair of the reinforcement ribs 30, and fixedly connected to the pair of the reinforcement ribs 30.

Each reinforcement rib 30 comprises a front rib portion 31, a middle rib portion 32, and a rear rib portion 33. The rear rib portion 33 has a bottom fixedly connected to the foot cover 10. A space 60 is formed between the middle rib portion 32 and the fin blade 20. The middle rib portion 32 has at least a cavity 321 extending axially and a plurality of through holes 322 interconnecting with the cavity 321.

In particular, a spring 40 is provided in the cavity 321. The spring 40 is adapted to improve the resilience of the reinforcement rib 30. The spring 40 has two ends each provided with a ring 41. The two rings 41 are connected to the front rib portion 31 and the rear rib portion 33, respectively. A limit rope 50 is provided in the spring 40. The limit rope 50 has two ends fixedly connected to the two ends of the spring 40 for preventing the reinforcement rib 30 from deformation or break. The spring 40 may be assembled into the middle rib portion 32 first, and then the two ends of the middle rib portion 32 are integrally formed with the front rib portion 31 and the rear rib portion 33.

The numbers of the cavity 321 and the spring 40 are not subject to only one. The middle rib portion 32 may have a plurality of cavities 321. Each cavity 321 is provided with a spring 40. This depends on the size of the product and the demand of resilience.

The feature of the present invention is that the spring 40 or the plurality of springs in the reinforcement rib 30 are to replace a conventional solid reinforcement rib, with the property of the spring 40 to improve the resilience of the reinforcement rib 30. The swim fin of the present invention provides a better resilience for a user to consume less energy and provides propulsion of the user in water, achieving the advantages of effort-saving and good flexibility.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A swim fin, comprising a foot cover, a fin blade, and a pair of reinforcement ribs extending from two sides of the foot cover, wherein the fin blade being disposed between the pair of the reinforcement ribs and fixedly connected to the pair of the reinforcement ribs, and characterized by:

each reinforcement rib comprising a front rib portion, a middle rib portion, and a rear rib portion, the rear rib portion having a bottom fixedly connected to the foot cover, the middle rib portion having at least a cavity extending axially and a spring in the cavity to improve the resilience of the reinforcement rib, the spring having two ends connected to the front rib portion and the rear rib portion, respectively, a limit rope, without slack in the rope, is provided in the spring, the limit rope having two ends fixedly connected to the two ends of the spring, the middle rib portion including at least a cavity extending axially and a plurality of through holes interconnecting with the cavity, the two ends of the spring are provided with two rings, and the two rings being connected to the front rib portion and the rear rib portion, respectively.

2. The swim fin as claimed in claim 1, wherein a space is formed between the middle rib portion and the fin blade.

* * * * *